US011820155B2

(12) United States Patent
Arakane

(10) Patent No.: US 11,820,155 B2
(45) Date of Patent: Nov. 21, 2023

(54) LIQUID EJECTION DEVICE, METHOD OF CONTROLLING LIQUID EJECTION DEVICE, AND NON-TRANSITORY COMPUTER-READABLE RECORDING MEDIUM THEREFOR

(71) Applicant: Brother Kogyo Kabushiki Kaisha, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 204 days.

(21) Appl. No.: 16/951,027

(22) Filed: Nov. 18, 2020

(65) Prior Publication Data

US 2021/0162771 A1 Jun. 3, 2021

(30) Foreign Application Priority Data

Nov. 29, 2019 (JP) ..... 2019-215967

(51) Int. Cl.
*B41J 2/21* (2006.01)
*B41J 2/045* (2006.01)
*B41J 2/14* (2006.01)

(52) U.S. Cl.
CPC ..... *B41J 2/2142* (2013.01); *B41J 2/04501* (2013.01); *B41J 2/14* (2013.01)

(58) Field of Classification Search
CPC ..... B41J 2/0451; B41J 2/16579; B41J 29/38; B41J 29/393; B41J 2/14; B41J 2/2142; B41J 2/04501
See application file for complete search history.

(56) References Cited

U.S. PATENT DOCUMENTS

2004/0184081 A1 9/2004 Yamamoto
2004/0207676 A1* 10/2004 Yamada ..... B41J 2/0451 347/81

(Continued)

FOREIGN PATENT DOCUMENTS

JP 2000-163225 A 6/2000
JP 2007-152889 A 6/2007

(Continued)

OTHER PUBLICATIONS

Japanese Office Action (Application No. 2019-215967) dated Sep. 5, 2023 (with English translation) (6 pages).

*Primary Examiner* — Jannelle M Lebron
(74) *Attorney, Agent, or Firm* — BURR PATENT LAW, PLLC

(57) ABSTRACT

A controller of a liquid ejection device is configured to receive a preparation signal instructing preparation to eject the liquid, the preparation signal being externally issued upon issuance of an ejection instruction to eject the liquid toward a target medium. The controller is configured to start receiving ejection data after the preparation signal is received, the ejection data being externally transmitted on condition that the ejection instruction is issued and after the preparation signal is issued. The controller is configured to control the liquid ejection head to eject the liquid toward the target medium through the multiple nozzles based on the ejection data. After receiving the preparation signal and before receipt of the ejection data is completed, the controller is configured to control the liquid ejection head to eject liquid through the multiple nozzles and examine at least a part of the nozzles for ejection-defectiveness based on the determination signal.

13 Claims, 12 Drawing Sheets

(56) References Cited

U.S. PATENT DOCUMENTS

| | | | |
|---|---|---|---|
| 2007/0139461 | A1 | 6/2007 | Izuo |
| 2010/0060689 | A1 | 3/2010 | Izuo et al. |
| 2011/0205273 | A1* | 8/2011 | Hibino ..... B41J 2/04581 347/10 |
| 2014/0210889 | A1 | 7/2014 | Gracia Verdugo et al. |
| 2014/0300657 | A1 | 10/2014 | Ike |
| 2015/0029249 | A1 | 1/2015 | Seino et al. |
| 2016/0224876 | A1 | 8/2016 | Horade |
| 2016/0236463 | A1 | 8/2016 | Kamiyanagi |
| 2017/0217186 | A1 | 8/2017 | Arai |

FOREIGN PATENT DOCUMENTS

| | | | |
|---|---|---|---|
| JP | 2008-036989 | A | 2/2008 |
| JP | 2010-058453 | A | 3/2010 |
| JP | 2011-251543 | A | 12/2011 |
| JP | 2013-116596 | A | 6/2013 |
| JP | 2014-200982 | A | 10/2014 |
| JP | 2015-024566 | A | 2/2015 |
| JP | 2016-140978 | A | 8/2016 |
| JP | 2016-150538 | A | 8/2016 |
| JP | 2017-132045 | A | 8/2017 |
| JP | 2017-132234 | A | 8/2017 |

* cited by examiner

LIQUID EJECTION DEVICE, METHOD OF CONTROLLING LIQUID EJECTION DEVICE, AND NON-TRANSITORY COMPUTER-READABLE RECORDING MEDIUM THEREFOR

CROSS-REFERENCE TO RELATED APPLICATIONS

This application claims priority under 35 U.S.C. § 119 from Japanese Patent Application No. 2019-215967 filed on Nov. 29, 2019. The entire subject matter of the application is incorporated herein by reference.

BACKGROUND

Technical Field

The present disclosures relate to a liquid ejection device configured to eject liquid through nozzles. The present disclosures also relate to a method of controlling the liquid ejection device, and a non-transitory computer-readable medium containing computer-executable instructions to be executed by a controller of the liquid ejection device.

Related Art

An inkjet recording device has been known as an example of a liquid ejection device configured to eject liquid through nozzles. The inkjet recording device is typically configured to eject ink droplets through nozzles to record an image on a sheet. In such an inkjet recording device, a recording head is controlled such that ink droplets are ejected from multiple nozzles sequentially, thereby performing a droplet ejection detecting operation in which it is checked whether each nozzle is an ejection-defective nozzle with use of a droplet ejection detecting device. Such a droplet ejection detecting operation may be performed before printing is performed.

SUMMARY

According to the above-mentions droplet ejection detecting operation, the recording head is controlled such that the ink droplet is ejected from each of the multiple nozzles in order, and whether each nozzle is the ejection-defective nozzle or not is determined with use of the droplet ejection detecting device, it takes some time to determine whether there exists an ejection-defective nozzle. Therefore, when the droplet ejection detecting operation is performed before the printing is started, there could be a situation where a time period from issuance of a print instruction to the start of printing becomes relatively long.

According to aspects of the present disclosures, there is provided a liquid ejection device having a liquid ejection head having multiple nozzles, a determination signal output part configured to output a determination signal corresponding to whether each of the multiple nozzles is an ejection-defective nozzle exhibiting ejection-defectiveness in ejecting liquid, and a controller. The controller is configured to perform receiving a preparation signal, the preparation signal being a signal instructing preparation to eject the liquid, the preparation signal being externally issued upon issuance of an ejection instruction to eject the liquid toward a target medium, starting to receive ejection data after the preparation signal is received, the ejection data being externally transmitted on condition that the ejection instruction is issued and after the preparation signal is issued, and controlling the liquid ejection head to eject the liquid toward the target medium through the multiple nozzles based on the ejection data. After receiving the preparation signal and before completion of receiving the ejection data, the controller is configured to perform controlling the liquid ejection head so that the multiple nozzles eject the liquid, and performing ejection-defectiveness determination by examining at least a part of the multiple nozzles for ejection-defectiveness based on the determination signal.

According to aspects of the present disclosures, there is provided a method of controlling a liquid ejection device having a liquid ejection head having multiple nozzles, and a determination signal output part configured to output a determination signal corresponding to whether each of the multiple nozzles is an ejection-defective nozzle exhibiting ejection-defectiveness in ejecting liquid. The method includes receiving a preparation signal, the preparation signal being a signal instructing preparation to eject the liquid, the preparation signal being externally issued upon issuance of an ejection instruction to eject the liquid toward a target medium, starting to receive ejection data after the preparation signal is received, the ejection data being externally transmitted on condition that the ejection instruction is issued and after the preparation signal is issued, and controlling the liquid ejection head to eject the liquid toward the target medium through the multiple nozzles based on the ejection data. After receiving the preparation signal and before completion of receiving the ejection data, the method further includes controlling the liquid ejection head so that the multiple nozzles eject the liquid, and performing ejection-defectiveness determination by examining at least a part of the multiple nozzles for ejection-defectiveness based on the determination signal.

According to aspects of the present disclosures, there is provided a non-transitory computer-readable recording medium for a liquid ejection device having a liquid ejection head having multiple nozzles, a determination signal output part configured to output a determination signal corresponding to whether each of the multiple nozzles is an ejection-defective nozzle exhibiting ejection-defectiveness in ejecting liquid, and a controller. The controller is configured to execute instruction contained in the recording medium to control the liquid ejection device to perform receiving a preparation signal, the preparation signal being a signal instructing preparation to eject the liquid, the preparation signal being externally issued upon issuance of an ejection instruction to eject the liquid toward a target medium, starting to receive ejection data after the preparation signal is received, the ejection data being externally transmitted on condition that the ejection instruction is issued and after the preparation signal is issued, and controlling the liquid ejection head to eject the liquid toward the target medium through the multiple nozzles based on the ejection data. After receiving the preparation signal and before completion of receiving the ejection data, the controller is configured to further control the liquid ejection device to perform controlling the liquid ejection head such that the multiple nozzles eject the liquid, and performing ejection-defectiveness determination by examining at least a part of the multiple nozzles for ejection-defectiveness based on the determination signal.

BRIEF DESCRIPTION OF THE ACCOMPANYING DRAWINGS

FIG. 1 schematically shows an inner configuration of a printer according to a present embodiment.

FIG. 2 explains a relationship among a detection electrode arranged inside a cap, a high-voltage power source circuit and a determination circuit.

DETAILED DESCRIPTION OF THE EMBODIMENTS

Hereinafter, referring to the accompanying drawings, an embodiment and modifications according to aspects of the present disclosures will be described.

Overall Configuration of Printer

Figure 1:
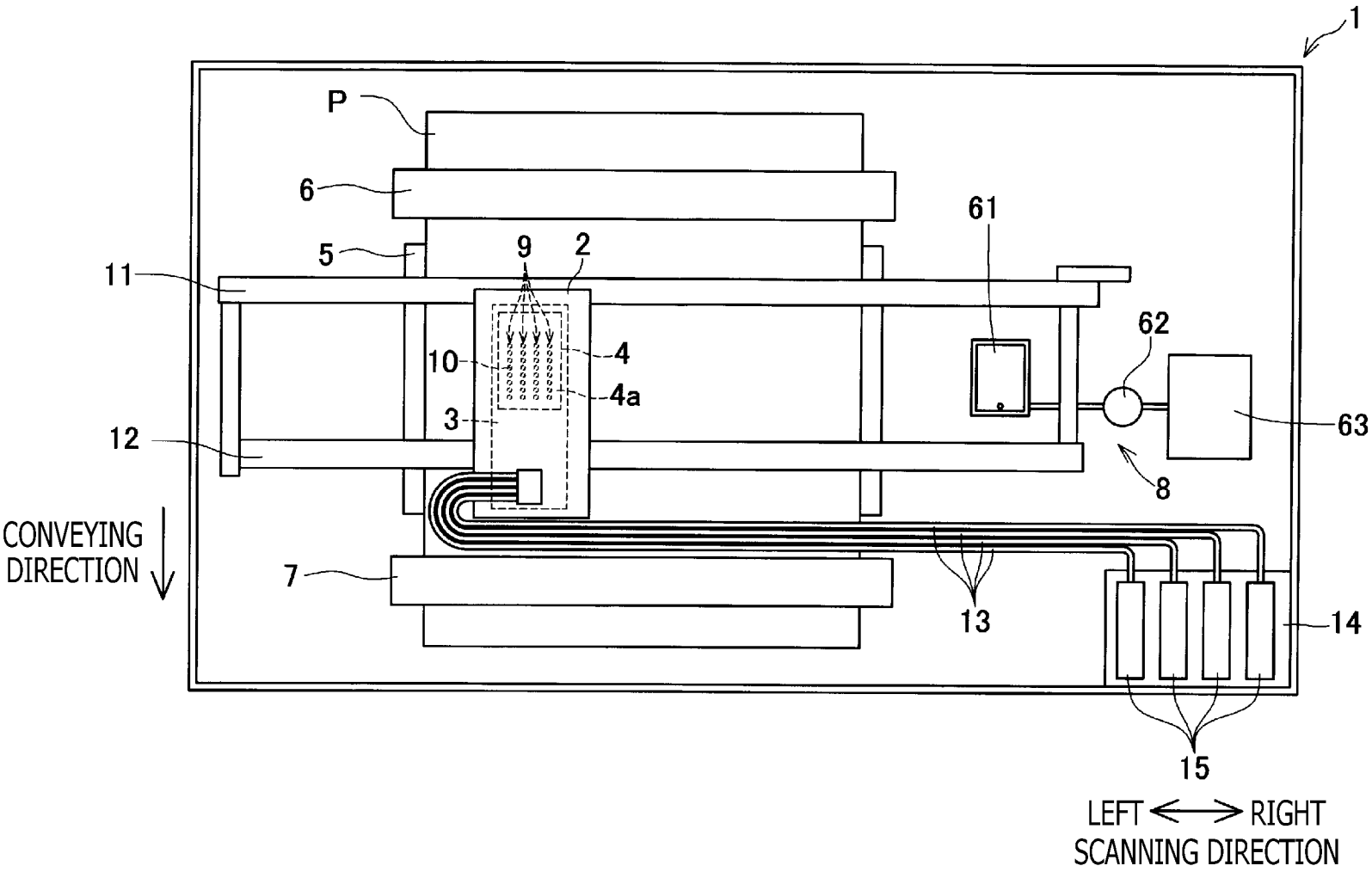

As shown in FIG. 1, a printer 1 according to an embodiment of the present disclosures includes a carriage 2, a sub-tank 3, an inkjet head 4, a platen 5, conveying rollers 6 and 7, and a maintenance unit 8. The printer 1 is an example of a liquid ejection device. The inkjet head 4 is an example of a liquid ejection head.

The carriage 2 is supported by guide rails 11 and 12, each extending in a scanning direction which is a right-left direction in FIG. 1. The carriage 2 is connected to a carriage motor 86 (see FIG. 4) via a belt (not shown). As the carriage motor 86 is driven to rotate, the carriage 2 moves, via the belt, in the scanning direction as guided by the guide rails 11 and 12. In the following description, a right side and a left side in the scanning direction indicated in FIG. 1 will be referred to.

The sub-tank 3 is mounted on the carriage 2. The printer 1 has a cartridge holder 14, and four ink cartridges 15 are detachably attached to the cartridge holder 14. In the four ink cartridges 15, from the right side one to the left side one, black, yellow, cyan, and magenta inks (which are examples of liquid) are stored. The sub-tank 3 is connected to the four ink cartridges 15 attached to the cartridge holder 14 with four tubes 13, respectively, thereby four different color inks being supplied from the four ink cartridges 15 to the sub-tank 3.

The inkjet head 4 is mounted on the carriage 2 and is connected to a lower end of the sub-tank 3. To the inkjet head 4, the above-described four colors of inks are supplied from the sub-tank 3. Further, the inkjet head 4 is configured to eject the inks (i.e., ink droplets) from a plurality of nozzles 10 formed on a nozzle surface 4*a*, which is a lower surface of the inkjet head 4. According to the present embodiment, the plurality of nozzles 10 forms nozzle arrays 9, each having multiple nozzles 10 aligned in a direction perpendicular to the scanning direction. As shown in FIG. 1, the inkjet head 4 according to the present embodiment has four nozzle arrays 9, which are parallelly aligned in the scanning direction. From the plurality of nozzles 10, from the rightmost nozzle array 9 toward the left side nozzle array 9, the black, yellow, cyan, and magenta ink droplets are ejected.

The platen 5 is arranged below the inkjet head 4 and faces the plurality of nozzles 10. The platen 5 extends in the scanning direction over an entire length of a recording sheet P (an example of a target medium) and supports the recording sheet P from below. The conveying roller 6 is arranged on an upstream side, in the conveying direction, with respect to the inkjet head 4 and the platen 5. The conveying roller 7 is arranged on a downstream side, in the conveying direction, with respect to the inkjet head 4 and the platen 5. The conveying rollers 6 and 7 are connected to the conveying motor 87 (see FIG. 4) through a well-known gear train. When the conveying motor 87 is driven to rotate, the conveying rollers 6 and 7 are rotated accordingly, thereby the recording sheet P is conveyed in the conveying direction.

The maintenance unit 8 is provided with a cap 61, a suction pump 62, and a waste liquid tank 63. The cap 61 is arranged on a right side, in the scanning direction, with respect to the platen 5. When the carriage 2 is located at a maintenance position, which is on a right side, in the scanning direction, with respect to the platen 5, the plurality of nozzles 10 faces the cap 61.

Figure 4:
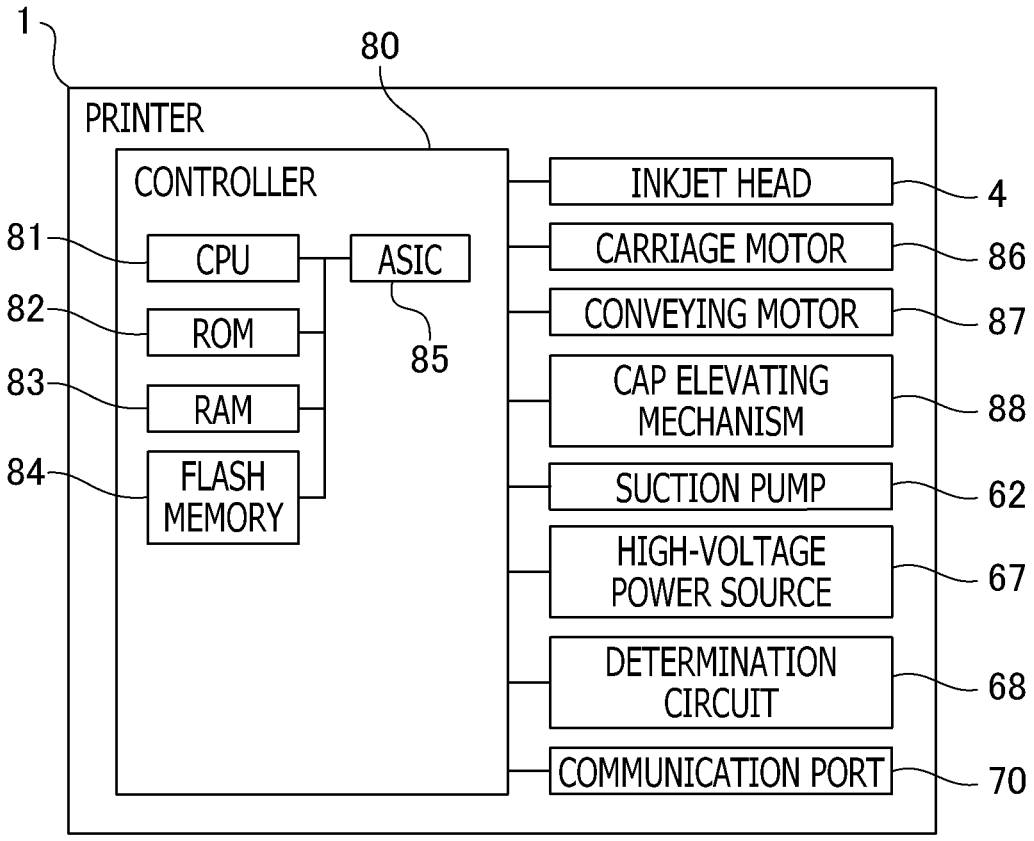
FIG. 4 is a block diagram illustrating an electric configuration of the printer according to the present embodiment.

The cap 61 is configured to be elevated and lowered by the cap elevating mechanism 88 (see FIG. 4). By elevating the cap 61 with the cap elevating mechanism 88 with the carriage 2 being located at the maintenance position and the plurality of nozzles 10 facing the cap 61, an upper end of the cap 61 closely contacts the nozzle surface 4*a*, and the plurality nozzles 10 is covered by the cap 61. It is noted that the cap 61 should not be limited to one which is configured such that the upper end thereof contacts the nozzle surface 4*a* to cover the plurality of nozzles 10. The cap 61 could be, for example, configured to closely contact a frame or the like (not shown) arranged to surround the nozzle surface 4*a* of the inkjet head 4 to cover the plurality of nozzles 10.

The suction pump 62 is, for example, a tube pump and is connected to the waste liquid tank 63. In the maintenance unit 8, by driving the suction pump 62 with the plurality of nozzles 10 being covered by the cap, a suction purge can be performed. The suction purge is an operation to cause the plurality of nozzles 10 to discharge the inks inside the inkjet head 4 by sucking the inks. The inks discharged ink by the suction purge is stored in the waste liquid tank 63.

In the above description, it is expediently explained that the cap 61 covers all of the plurality of nozzles 10, and thus, by the suction purge, the inks in the inkjet head 4 are discharged from all of the plurality of nozzles 10. However, the aspects of the present disclosures are not necessarily be limited to such a configuration. For example, the cap 61 may include a part configured to cover the plurality of nozzles constituting the rightmost nozzle alley 9 configured to eject the black ink and another part configured to cover the plurality of nozzles constituting three nozzles arrays 9 arranged on the left side with respect to the rightmost nozzle alley 9 and configured to eject the color inks (i.e., the yellow, the cyan and the magenta inks), and the black ink or the color inks in the inkjet head 4 are selectively discharged. For another example, a cap 61 may be provided for each nozzle array 9, and the inks may be discharged from the nozzles 10 of the respective nozzle arrays 9.

Figure 2:
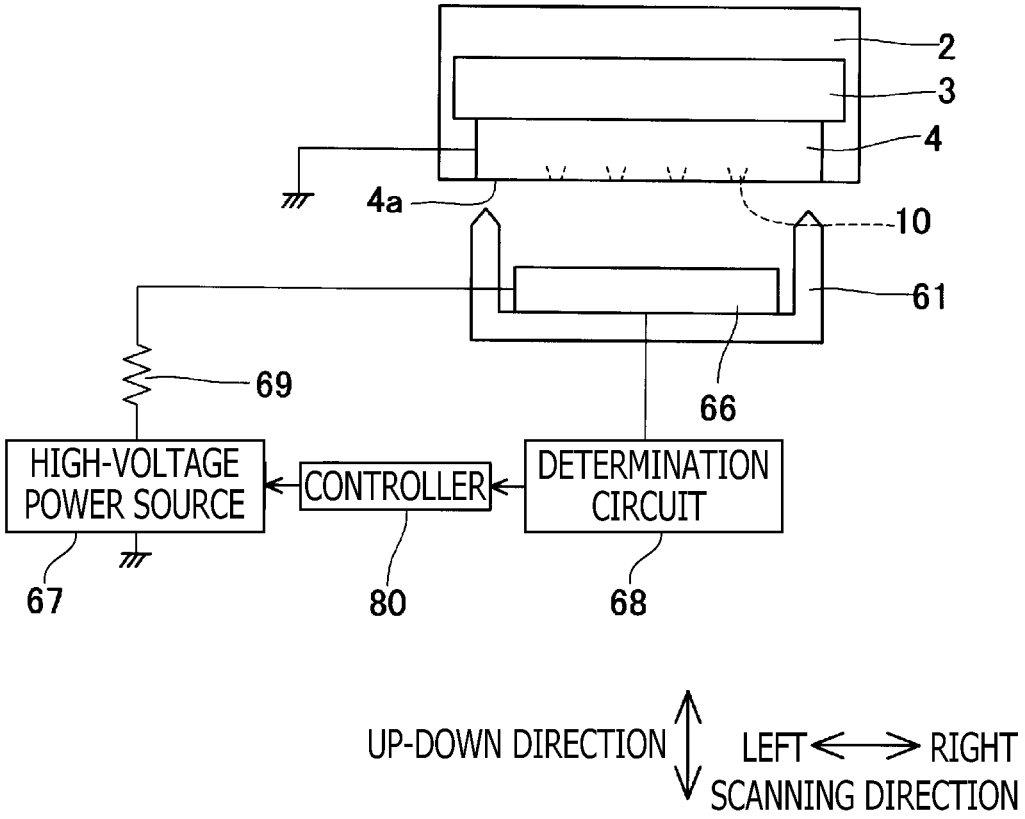

As shown in FIG. 2, inside the cap 61, a detection electrode 66, which has a rectangular shape in a plan view, is arranged inside the cap 61. The detection electrode 66 is connected to a high-voltage power source 67 through a resistor 69. A particular positive voltage (e.g., approximately 300 V) is applied, by the high-voltage power source 67, to the detection electrode 66. On the other hand, the inkjet head 4 is held at ground potential. Accordingly, a particular potential difference is generated between the inkjet head 4 and the detection electrode 66. Further, a determination circuit 68 is connected to the detection electrode 66. The determination circuit 68 compares a voltage value of a voltage signal output from the detection electrode 66 with a threshold voltage Vt, and outputs a signal corresponding to the comparison result.

Specifically, since a potential difference is generated between the inkjet head 4 and the detection electrode 66, the ink droplet ejected from the nozzles 10 is charged. When the ink droplet is ejected from the nozzles 10 toward the detection electrodes 66 with the carriage 2 located at the maintenance position, the charged ink droplet approaches the detection electrode 66, and the voltage value of the detection electrode 66 rises from a voltage value V1, which is a voltage when the inkjet head 4 is not driven, to a voltage value V2 which is higher than the voltage value V1 until the ink droplet impacts the detection electrode 66. Then, after the charged ink droplet has impacted the detection electrode 66, the voltage value of the detection electrode 66 gradually decreases back to the voltage value V1. That is, during a driving time period Td of the inkjet head 4, the voltage value of the detection electrode 66 varies.

Figure 3A:
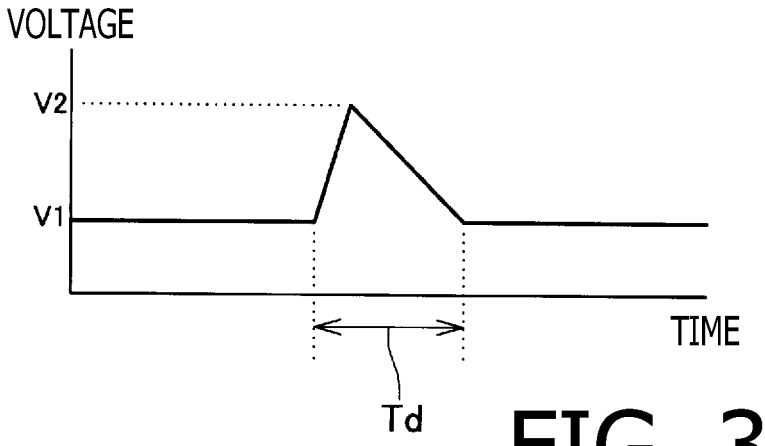
FIG. 3A is a graph showing a change of a voltage of the detection electrode when an ink droplet is ejected from a nozzle.
Figure 3B:
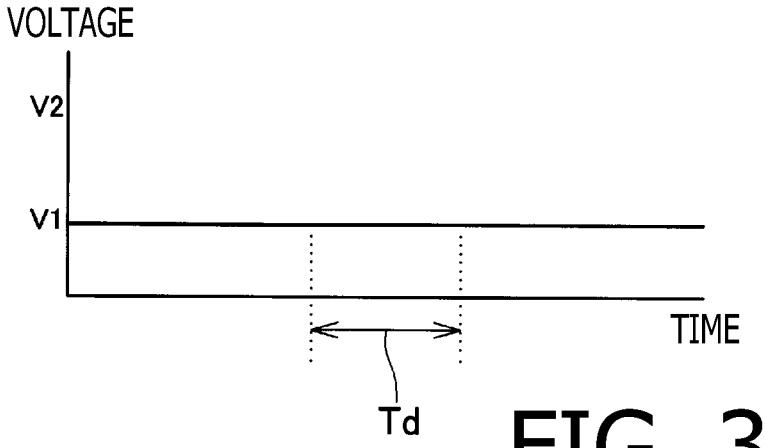
FIG. 3B is a graph showing a change of a voltage of the detection electrode when no ink droplet is ejected from the nozzle.

On the other hand, when the ink droplet is not ejected from the nozzles 10, the voltage value of the detection electrode 66 does not substantially vary during the driving period Td of the inkjet head 4, as shown in FIG. 3B. In order to distinguish a case where the ink droplet is ejected through the nozzles 10 from a case where the ink droplet is not ejected through the nozzles 10, a threshold value VT is set to the determination circuit 68, where the threshold value Vt is larger than the voltage value V1 and less than the voltage value V2. Then, the determination circuit 68 compares the maximum voltage value of the voltage signal output by the detection electrode 66 with the threshold value Vt during the driving period Td of the inkjet head 4, and outputs a determination signal corresponding to the determination result. It is noted that a combination of the determination circuit 66, the high-voltage power source 67, the resistor 69 and the determination circuit 68 is an example of a determination signal output circuit. Further, the determination signal output circuit outputs a determination signal corresponding to whether each nozzle 10 is an ejection-defective nozzle that cannot eject an ink droplet.

In the present embodiment, the positive potential is applied to the detection electrode by the high-voltage power source 67. The configuration may be modified such that a negative potential (e.g., approximately −300 V) may be applied to the detection electrode by the high-voltage power source 67. In this case, when the ink droplets are ejected toward the detection electrode 66 from the nozzles 10 with the carriage 2 being located at the maintenance position, the charged ink droplet approaches the detection electrode 66. Until the ink droplet impacts the detection electrode 66, the voltage value V1 of the detection electrode 66 is lowered from the voltage value V1. Then, after the ink droplet impacts the detection electrode 6, the voltage value of the detection electrode 66 gradually increases and returns to the voltage value V1.

Electrical Configuration of Printer

Next, an electrical configuration of the printer 1 will be described. An operation of the printer 1 is controlled by a controller 80. As shown in FIG. 4, the controller 80 includes a CPU 81, a ROM 82, a RAM 83, a flash memory 84, an ASIC 85 and the like. The controller 80 controls operations of the inkjet head 4, the carriage motor 86, the conveying motor 87, the cap elevating mechanism 88, the high-voltage power source 67, the suction pump 62 and the like.

To the controller 80, the determination signal is input from the determination circuit 68. Further, printer 1 has a communication port 70. The communication port 70 is for connecting with external devices such as a PC or a smartphone through, for example, a LAN. The controller 80 performs communication with an external device through the communication port 70. It is noted that the communication port 70 is for connecting with the external device either by a wired or wireless connection.

It is noted that the controller 80 may be configured such that only the CPU 81 performs various processes, only the ASIC 85 performs various processes, or the CPU 71, cooperating with the ASIC 85, performs various processes. Further, the controller 80 may be configured such that only one CPU 81 performs each process, or a plurality of CPUs perform each process in a shared manner. Furthermore, the controller 80 may be configured such that a single ASIC 85 performs each process, or a plurality of ASICs performs each process in a shared manner.

Control When Recording is Performed

Next, a process of recording on the recording sheet P in the printer 1 will be described. In the printer 1, an image is recorded on the recording sheet P by performing a recording pass and a conveying operation alternately and repeatedly. The recording pass is a process of causing the inkjet head 4 to eject the ink droplets from the multiple nozzles 10 toward the recording sheet P with moving the carriage 2 in the scanning direction. The conveying operation is to move the recording sheet P in the conveying direction. It is noted that, according to the present embodiment, an operation of recording the image on the recording sheet P by alternately performing the recording pass and the conveying operation is an example of an ejection operation. The single recoding pass and the single conveying operation do not need to be performed alternately. For example, depending on a situation where the recording is performed, the conveying operation may be performed after a plurality of recording passes is performed.

Further, according to the present embodiment, the printer 1 is configured to record an image on the printing sheet P either in a normal-quality recording mode (which is an example of a first recording mode) or in a high-quality recording mode (which is an example of a second recording mode).

According to the present embodiment, on condition that the user instructs recording of the image on the recording sheet P on the PC, the smartphone or the like, which are connected to the printer 1 through the communication port 70, a preparation signal instructing a preparation for image recordation on the recording sheet P is transmitted from such a device (i.e., the PC, the smartphone or the like) to the printer 1. Thereafter, image data corresponding to respective recording passes is transmitted, from the device (i.e., the PC, the smartphone, or the like) to the printer 1, sequentially, in order from the image data corresponding to the first recording pass. It is noted that, according to the present embodiment, the image data corresponding to the first recording pass is an example of ejection data.

Figure 5:
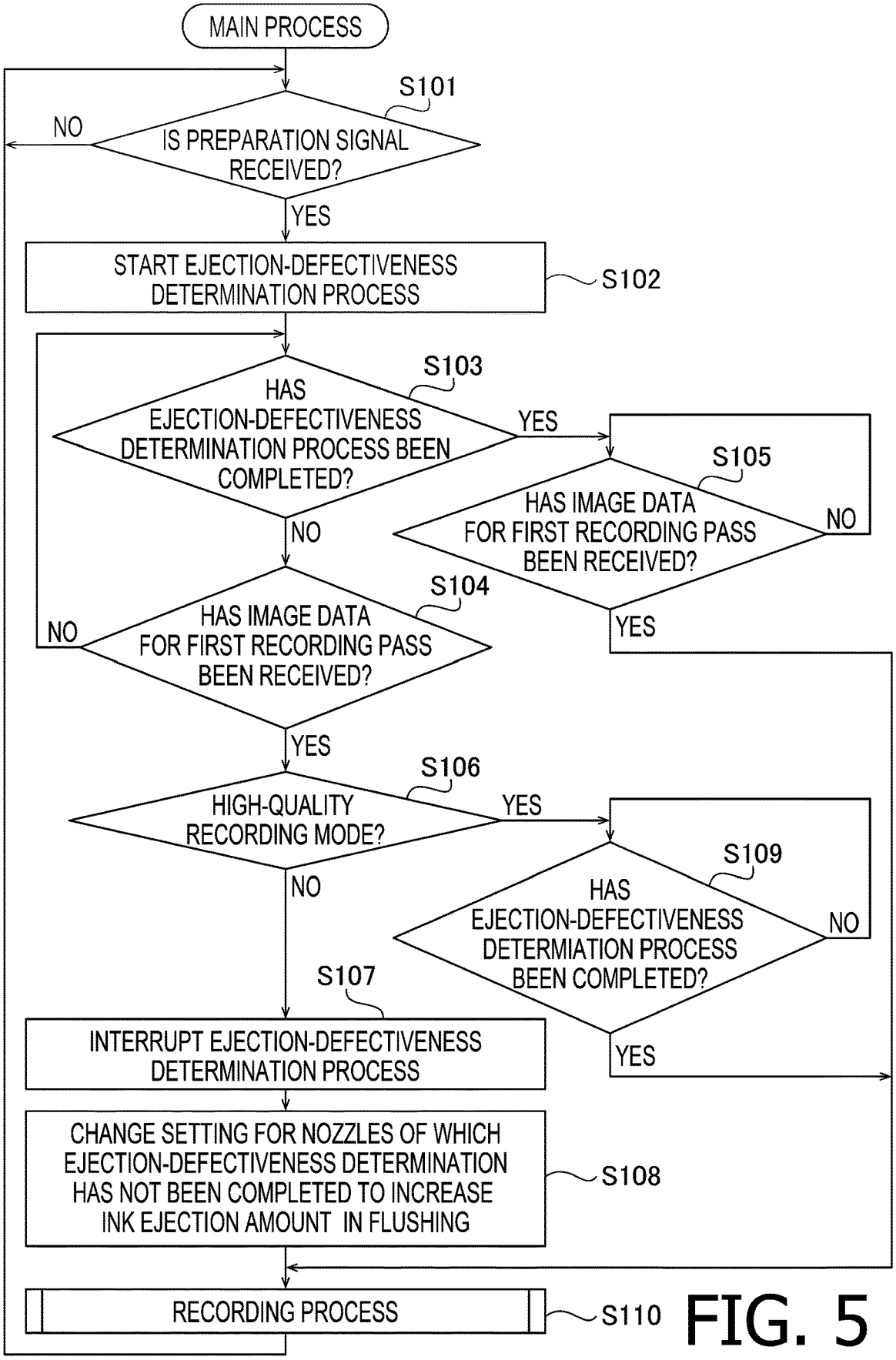
FIG. 5 is a flowchart illustrating a main process when printing is to be performed.

Correspondingly, the controller 80 starts a main process illustrated in a flowchart shown in FIG. 5 when the printer 1 is powered on. The main process shown in FIG. 5 is performed when the printer is being powered on.

In the main process, the controller 80 pauses until the preparation signal is received (S101: NO). When the preparation signal is received (S101: YES), the controller 80 starts an ejection-defectiveness determination process to determine whether each nozzle 10 is the ejection-defective nozzle or not (S102). The ejection-defectiveness determination process will be described in detail later.

Next, the controller 80 pauses as long as the ejection-defectiveness determination process has not been completed (S103: NO) and the image data of the first recording pass has not been received (S104: NO). When the ejection-defectiveness determination process has completed (S103: YES) before the image data for the first recording pass is received, the controller 80 waits until the image data of the first recording pass is completed (S105: NO). When the image data of the first recording pass has been received (S105: YES), the controller 80 proceeds to a recording process in S110.

When the image data for the initial recording pass has been received (S104: YES) before the ejection-defectiveness determination process completes (S103: NO), the controller 80 determines whether the recording mode for recording the received image is the high-quality recording mode (S106). The information regarding the recording mode (i.e., whether the recording mode for the received image is the normal-quality recording mode or the high-quality recording mode) is included in the preparation signal, and the controller 80 makes the determination in S106 based on the information.

When it is determined that the recording mode is the normal-quality recording mode (S106: NO), the controller 80 instructs to interrupt the ejection-defectiveness determination process (S107). For the nozzles 10 for which the ejection-defectiveness determination process has not been completed, the controller 80 changes a setting for flushing so that a discharging amount of the ink in flushing is increased (S108). Thereafter, the controller 80 proceeds to the recording process in S110.

When it is determined that the recording mode is the high-quality recording mode (S106: YES), the controller 80 pauses until the ejection-defectiveness determination process is completed (S109: NO). When the ejection-defectiveness determination process is completed (S109: YES), the controller 80 proceeds to the recording process in S110.

Figure 6:
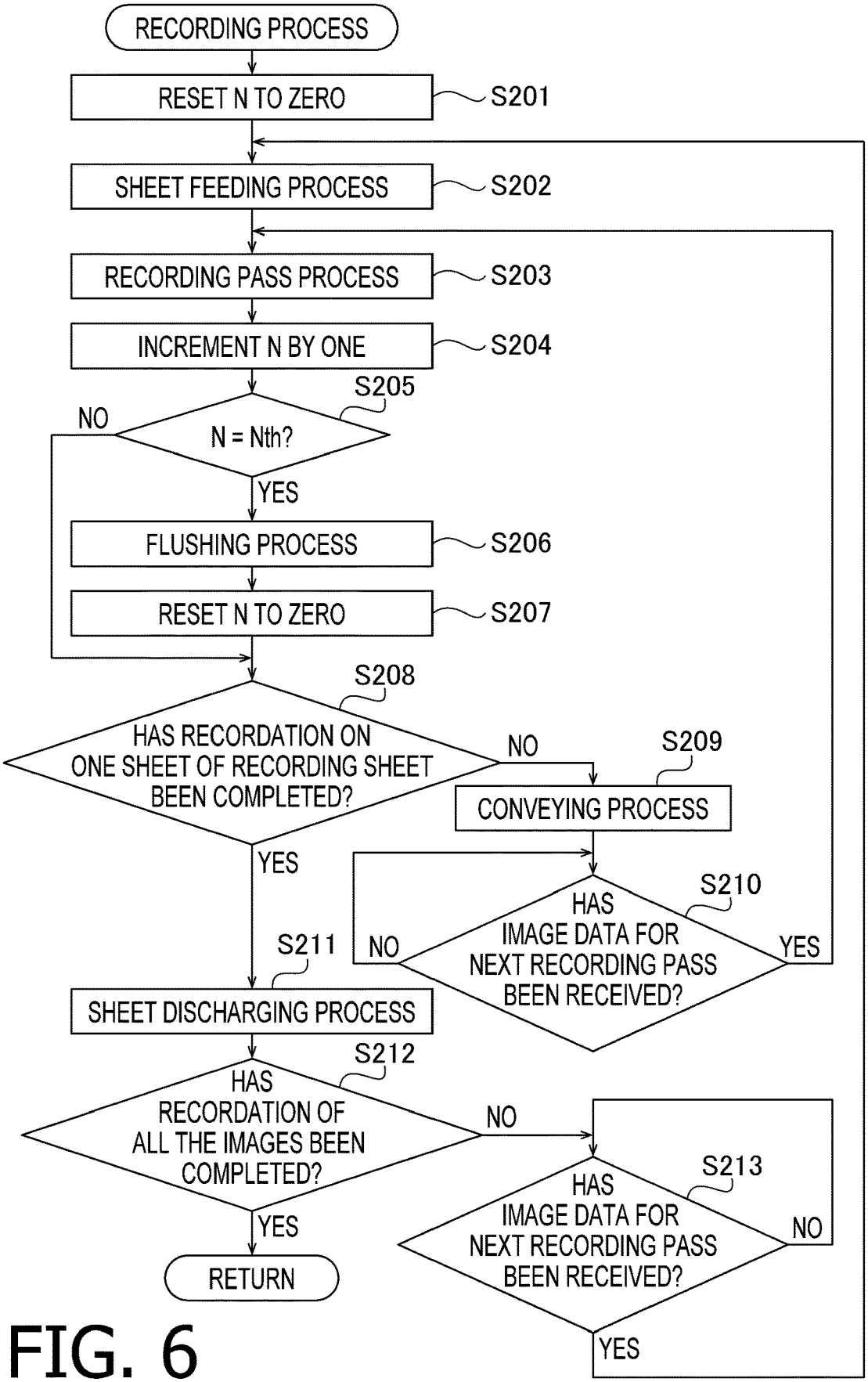
FIG. 6 is a flowchart illustrating a recording process which is called in the main process shown in FIG. 5.

In the recording process (S110), the controller 80 performs the recording process shown in FIG. 6. In S201, the controller 80 resets a variable N to zero. The variable N represents the number of recording passes having been performed.

Next, the controller 80 performs a sheet feeding process (S202). In the sheet feeding process, the controller 80 controls a sheet feeding device and the conveying motor 87 to cause the sheet feeding device and the conveying roller 6 to feed the recording sheet P and to position the recording sheet 6 at a position where the initial recording pass is to be performed.

Next, the controller 80 performs the recording pass process (S203). In the recording pass process (S203), the controller 80 controls the carriage motor 86 to move the carriage 2 in the scanning direction, while performs the recording pass to control the inkjet head 4 based on the image data, thereby causing the plurality of nozzles 10 to eject ink droplets toward the recording sheet P. Thus, a one-pass amount of image corresponding to the image data is recorded on the recording sheet P.

Next, the controller 80 increments the variable N by one (S204) and determines whether the variable N is equal to a particular value Nth (S205). When it is determined that the variable N is not equal to the particular value Nth, that is, when the variable N is less than the particular value Nth (S205: NO), the controller 80 proceeds to S208.

When the variable N is equal to the particular value Nth (S205: YES), the controller 80 performs a flushing process (S206). In the flushing process in S206, the controller 80 performs the flushing operation, which is an operation of controlling the carriage motor 86 to move the carriage 2 to the maintenance position, and driving the inkjet head 4 to cause the plurality of nozzles 10 to discharge the ink droplets. At this stage, when there are nozzles 10 of which settings have been changed in S108 so that the ink discharging amount is increased, the controller 80 controls the inkjet head 4 so that the ink discharging amounts of the nozzles 10 of which settings have been changed are increased in comparison with the ink discharging amount of the other nozzles 10. It is noted that, according to the present embodiment, the flushing operation is an example of a discharging operation, and the inkjet head 4 performing the flushing operation is an example of a discharging device.

After performing the flushing process in S206, the controller 80 resets the variable N to zero (S207) and proceeds to S208. Thus, according to the present embodiment, during the image recordation on the recording sheet P, the flushing operation is performed at every Nth time execution of the recording pass.

In S208, the controller 80 determines whether the recording of an image on one sheet of the recording sheet P has completed. When it is determined that the recordation on one sheet of the recording sheet P has not completed (S208: NO), the controller 80 performs a conveying process (S209). In the conveying process (S209), the controller 80 controls the conveying motor 87 to cause the conveying rollers 6 and 7 to convey the recording sheet P by a particular distance. Next, the controller 80 pauses until the image data for the next recording pass is received (S210: NO). When it is determined that the image data for the next recording pass has been received (S210: YES), the controller proceeds to S203.

When it is determined that the recording of the image on one sheet of the recording sheet P has completed (S208: YES), the controller 80 performs a sheet discharging process (S211). In the sheet discharging process (S211), the controller 80 controls the conveying motor 87 to cause the conveying rollers 6 and 7 to discharge the recording sheet P.

When it is determined that the recording of all the images has not been completed (S212: NO), the controller 80 pauses unit the image data for the next recording pass has been received (S213: NO). When the image data for the next recording pass has been received (S213: YES), the controller 80 returns to S202. When it is determined that the recording of all the images has been completed (S212: YES), the controller returns to S101 of the main process shown in FIG. 5.

Ejection-defectiveness Determination Immediately Before Recordation

Next, an ejection-defectiveness determination performed after receipt of the preparation signal and before completion of receipt of the image data for the first recording pass (hereinafter, simply referred to, occasionally, as "ejection-defectiveness determination immediately before recordation") will be described. According to the present embodiment, as the controller 80 performs a flowchart shown in FIG. 7 (i.e., an ejection-defectiveness determination process), the ejection-defectiveness determination immediately before recordation is performed.

In S301, the controller 80 controls the carriage motor 86 to move the carriage 2 to the maintenance position. Next, the controller 80 retrieves a first order data (S302). The first order data represents the order set to target nozzles 10, which are subjected to the ejection-defectiveness determination in the ejection-defectiveness determination immediately before recordation and is stored, for example, in the EEPROM 84 or the like in advance. The first order data indicates that the nozzles 10 ejecting the black ink, and then the nozzles 10 ejecting the color inks are set as the target nozzles in this order. Further, the first order data indicates that, for each nozzle array 9, a target nozzle is set in the order from a nozzle 10 arranged on an outer side, in the conveying direction, toward a nozzle 10 arranged on an inner side in the conveying direction. In other words, the first order data indicates that the nozzles 10 of which ink tends to thicken are set as the target nozzles 10 earlier.

According to the present embodiment, in a relationship between the nozzles 10 ejecting the black ink and the nozzles 10 ejecting the color inks, the nozzles 10 ejecting the color inks are examples of first nozzles, while the nozzles ejecting the black ink are examples of second nozzles. Further, in a relationship between two arbitrary nozzles 10 among the plurality of nozzles 10 in each nozzle array 9, a nozzle 10 arranged more centrally in the conveying direction is an example of a first nozzle, while a nozzle 10 arranged more outside in the conveying direction is an example of a second nozzle.

Next, the controller 80 sets one of the plurality of nozzles 10 of the inkjet head 4 as the target nozzle based on the retrieved first order data (S303). The controller 80 controls the inkjet head 4 to cause the target nozzle to eject the ink droplet toward the detection electrode 66 arranged inside the cap 61 (S304). Next, the controller 80 determines whether the target nozzle is the ejection-defective nozzle based on the determination signal output from the determination circuit (S305).

When the controller 80 does not receive a determination interrupting instruction (S306: NO), and the controller 80 has not completed the ejection-defectiveness determination for all of the plurality of nozzles 10 (S307: NO), the controller sets another one of the plurality of nozzles 10 as the target nozzle based on the first order data (S308) and returns to S304.

When the controller 80 does not receive the determination interrupting instruction (S306: NO), and the controller 80 has completed the ejection-defectiveness determination for all of the plurality of nozzles 10 (S307: YES), the controller 80 determines whether there are nozzles determined to be the ejection-defective nozzles among all the nozzles 10 of the inkjet head 4 (S309). When the controller 80 has received the determination instruction (S306: YES), the controller 80 determines whether there are nozzles determined to be the ejection-defective nozzles among the nozzles for which the abnormal determination has completed (S309).

When there is no ejection-defective nozzle (S309: NO), the controller 80 terminates the ejection-defectiveness determination process shown in FIG. 7. When there is (are) the ejection-defective nozzle(s) (S309: YES), the controller 80 causes the ejection-defective nozzles to perform flushing (S310) and terminates the ejection-defectiveness determination process shown in FIG. 7. In S310, the controller 80 causes the carriage motor 86 to move to the maintenance position and controls the inkjet head 4 to cause the nozzle(s) determined to be the ejection-defective nozzle(s) to discharge the ink droplets (i.e., flushing).

Ejection-defectively Determination at Timing Not Immediately Before Recordation

Figure 8:
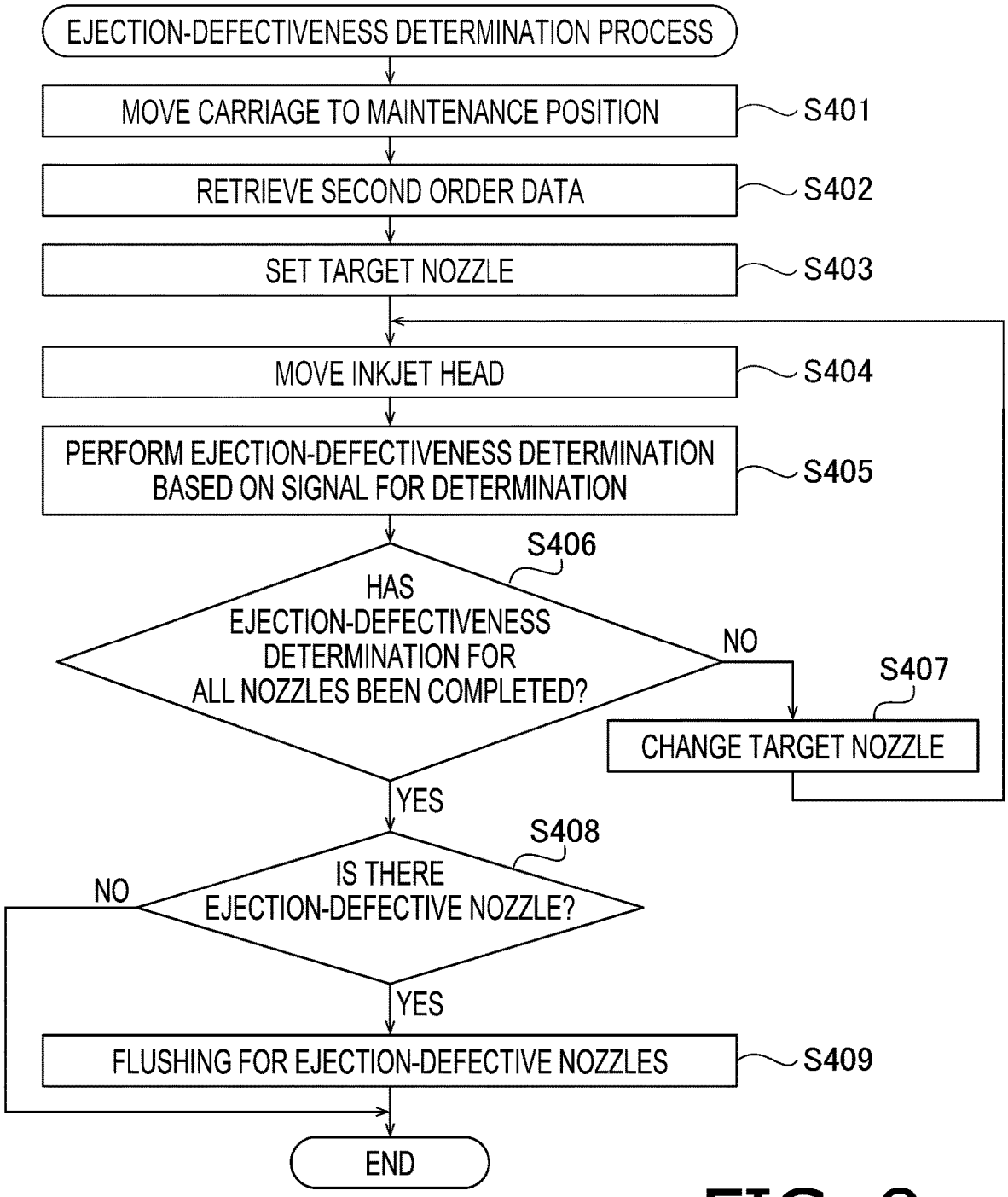
FIG. 8 is a flowchart illustrating an ejection-defectiveness determination process to be performed at a timing other than a timing which is immediately before the recording process.

Further, according to the embodiment, the ejection-defectiveness determining process is performed at a timing that is not immediately before recordation (e.g., when recordation has not been performed for a certain fixed period). In such a case, the controller 80 performs the ejection-defectiveness determination process in accordance with a flowchart shown in FIG. 8.

Figure 7:
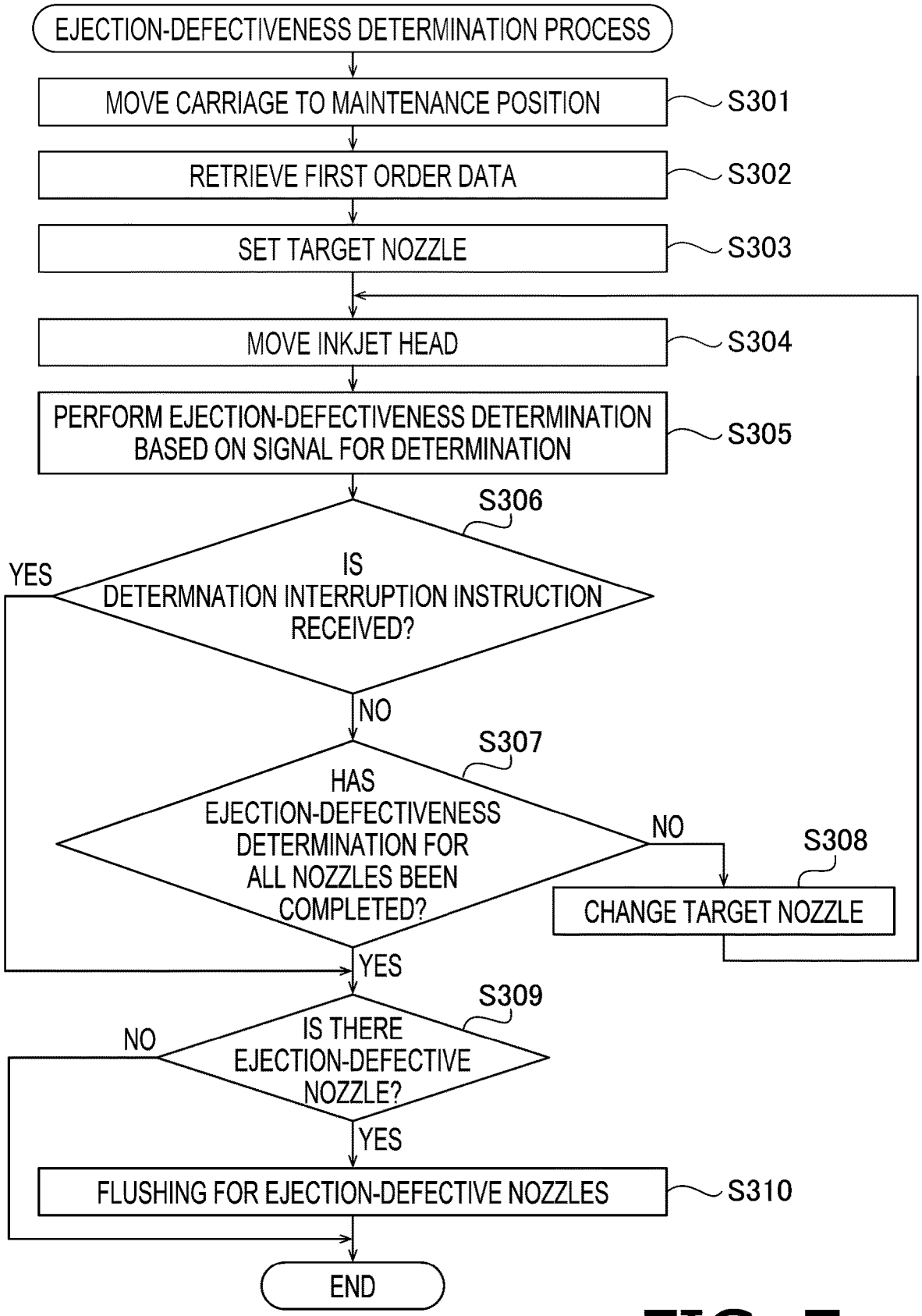
FIG. 7 is a flowchart illustrating an ejection-defectiveness determination process to be performed immediately before the recording process.

In S401, the controller 80 moves the carriage 2 to the maintenance position, as is done in S301 of FIG. 7. Next, the controller 80 retrieves second order data (S402). It is noted that the second order data is data indicating order to be assigned to each target nozzle among the plurality of nozzles 10 in the ejection-defectiveness determination process performed at a timing which is not immediately before recordation, and is stored, for example, in the EEPROM 84, in advance. The second order data indicates that whether the nozzles 10 ejecting the color inks and the nozzles 10 ejecting the black ink are ejection-defective nozzles in this order. Further, for each nozzle array 9, the second order data indicates that whether a nozzle 10 is the ejection-defective nozzle is determined from a nozzle 10 arranged at a more central position in the conveying direction toward a nozzle 10 arranged at an end position in the conveying direction.

Next, the controller 80 sets one nozzle 10 as the target nozzle based on the second order data (S403) and drives the inkjet head 4 to cause the target nozzle 10 to eject the ink droplet toward the detection electrode 66 arranged inside the cap 61 (S404).

When the ejection-defectiveness determination process for all the nozzles 10 has not been completed (S406: NO), the controller 80 changes the target nozzle to another nozzle 10 based on the second order data (S407) and returns to S404.

When the ejection-defectiveness determination process for all the nozzles 10 has been completed (S406: YES), the controller 80 determines whether there are nozzles 10, which are determined to be the ejection-defective nozzles (S408). When there are no nozzles 10 determined to be the ejection-defective nozzles A(S408: NO), the controller 80 terminates the ejection-defectiveness determination process shown in FIG. 8. When there are one or more nozzles 10 determined to be the ejection-defective nozzle(s) (S408: YES), the controller 80 causes the nozzle(s) 10 determined to be the ejection-defective nozzle(s) to eject the ink droplet(s), as is done in S309 of FIG. 7, and terminates the ejection-defectiveness determination process shown in FIG. 8.

Effects

According to the present embodiment, after receiving the preparation signal and before the image data for the first recording pass has been completed, the controller 80 performs the ejection-defectiveness determination process. Thus, in comparison with a case where the ejection-defectiveness determination is performed after receipt of the preparation signal and after the first image data has been received, a time period from an instruction to record an image on the recording sheet P until the recording of the image on the recording sheet P is actually performed can be shortened.

According to the present embodiment, the black ink is thickened easier than the color inks. Further, the ink is thickened easier in the nozzles 10, in each nozzle array 9, arranged on outer sides in the conveying direction than in the nozzles 10, in each nozzle array 9, arranged on the central portion in the conveying direction. On the other hand, since a time period from receipt of the preparation signal to completion of receipt of the image data for the first recording pass is relatively short, the ejection-defectiveness determination process for all the nozzles 10 may not be completed during such a short period.

Therefore, according to the present embodiment, the ejection-defectiveness of the nozzle is determined for the nozzles 10 ejecting the black ink and for the nozzles 10 ejecting the color inks in this order in the ejection-defectiveness determination process performed during a period from the preparation signal has been received and before the image data for the first recording pass has been received. Further, the nozzles 10 in each nozzle array 9, the ejection-defectiveness is determined for the nozzles arranged on the outer sides in the conveying direction. In other words, the ejection-defectiveness of the nozzle is determined from the nozzle 10 in which the ink could thicken easily. Accordingly, the ejection-defectiveness of the nozzles in which the ink is thickened easily can be determined efficiently during the above-described period.

When the ejection-defectiveness determination process is performed at a timing which is different from the above-described period, the ejection-defectiveness of the nozzle is determined for the nozzles ejecting the color inks and for the nozzles 10 ejecting the black ink in this order in the ejection-defectiveness determination process. Further, the nozzles 10 in each nozzle array 9, the ejection-defectiveness is determined for the nozzles arranged on the central portion in the conveying direction. In other words, the ejection-defectiveness of the nozzle is determined from the nozzle 10 in which the ink would not thicken easily. Accordingly, it becomes hardly happen that, during a period when the ejection-defectiveness of a certain nozzle 10 has been completed, and the ejection-defectiveness of another nozzle 10 is being determined, the certain nozzle 10 turns to the ejection-defective nozzle due to thickening of the ink therein.

Further, according to the above-described embodiment, when the recording is performed in the normal-quality recording mode, in which the required image quality is not so high, after the preparation signal has received and the image data for the first recording pass has been received before the ejection-defectiveness determination process is completed, the ejection-defectiveness determination process is interrupted during execution, and recordation on the recording sheet P is performed. Thus, it is possible to prevent recordation on the recording sheet P from being delayed.

On the other hand, even when the preparation signal has been received and the image data for the first recording pass has been received before the ejection-defectiveness determination process is completed, if recordation is to be performed in the high-quality recording mode, which requires a high image quality, recordation of the image on the recording sheet P is performed after the ejection-defectiveness determination process is completed. Thus, since the ejection-defectiveness determination process has been performed for all the nozzles 10, the high image quality is guaranteed.

When the ejection-defectiveness determination process is interrupted during execution and recordation on the recording sheet P is to be performed, the ejection-defectiveness determination process has not been completed in the flushing, which is to be performed during the recording process. In such a case, for the nozzles 10, which are not determined to be abnormal or not (i.e., the nozzles 10 which may or may not be ejection-defective nozzles), the ink discharging amount is increased. Thus, although the ink ejection amount in the flushing is increased, even though the ejection-defective nozzles are included among the nozzles 10 which are not determined to be abnormal or not, the ejection-defectiveness can be recovered by performing the flushing.

Modifications

It is noted that aspects of the present disclosures do not need to be limited to the configuration of the above-described embodiment, but the above-described embodiment can be modified in various ways within aspects of the present disclosures.

In the above-described embodiment, in the ejection-defectiveness determination process, the inkjet head 4 is driven such that the ink is ejected from only one nozzle 10, and it is determined whether the one nozzle 10 is the ejection-defective nozzle or not based on the determination signal. However, aspects of the present disclosures do not need to be limited to the configuration above. For example, according to a first modification, a first ejection-defectiveness determination or a second ejection-defectiveness determination is selectively performed as the ejection-defectiveness determination process.

In the first ejection-defectiveness determination process, as in the above-described embodiment, the inkjet head 4 is driven so that an ink droplet is ejected from the one nozzle 10 toward the detection electrode 66 and determines whether the one nozzle 10 is the ejection-defective nozzle or not based on the signal for detection. In the second abnormal detection process, the inkjet head 4 is driven so that ink droplets are ejected simultaneously from a particular number of plural nozzles 10 toward the detection electrode 66 and determines whether the particular number of multiple nozzles 10 include the ejection-defective nozzle based on the determination signal. According to this configuration, a time period necessary to perform the second ejection-defectiveness determination process is shorter than a time period necessary to perform the first ejection-defectiveness determination process for the same number of nozzles 10.

Figure 9A:
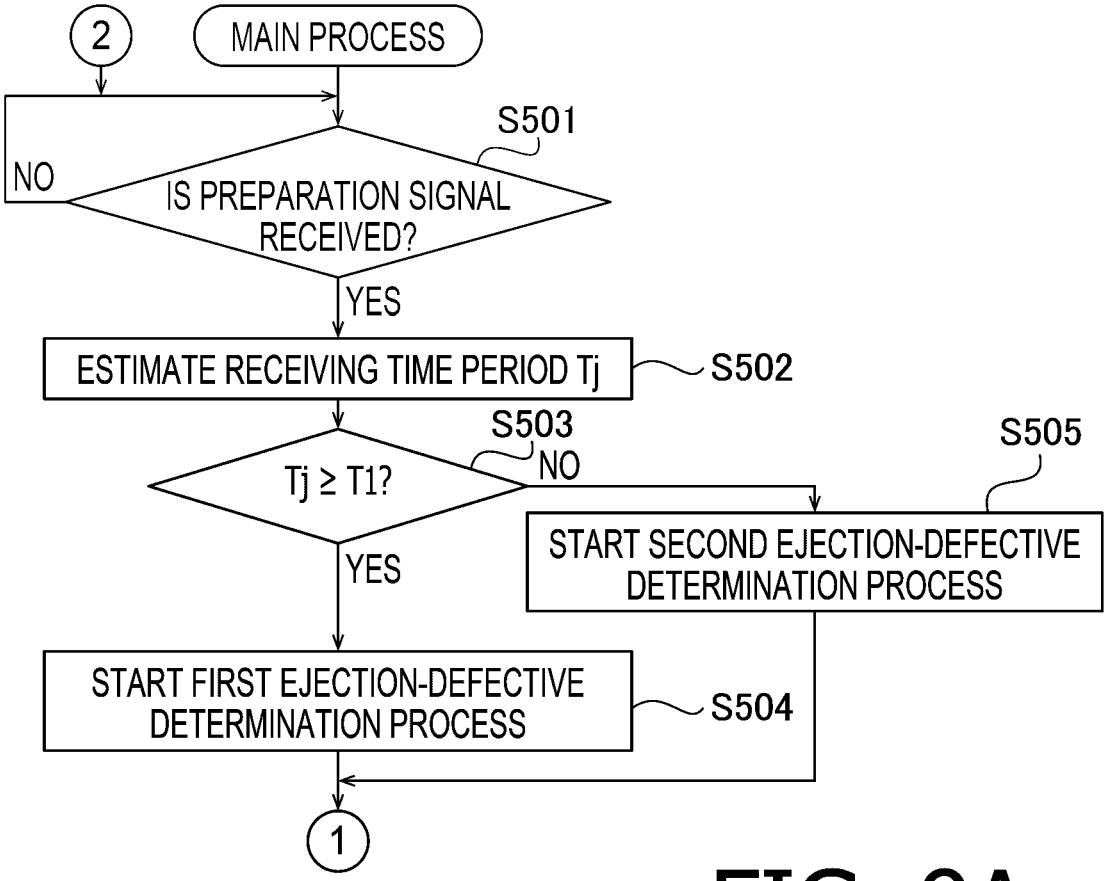
FIGS. 9A and 9B show a flowchart illustrating a main process of a printer according to a modified embodiment.
Figure 9B:
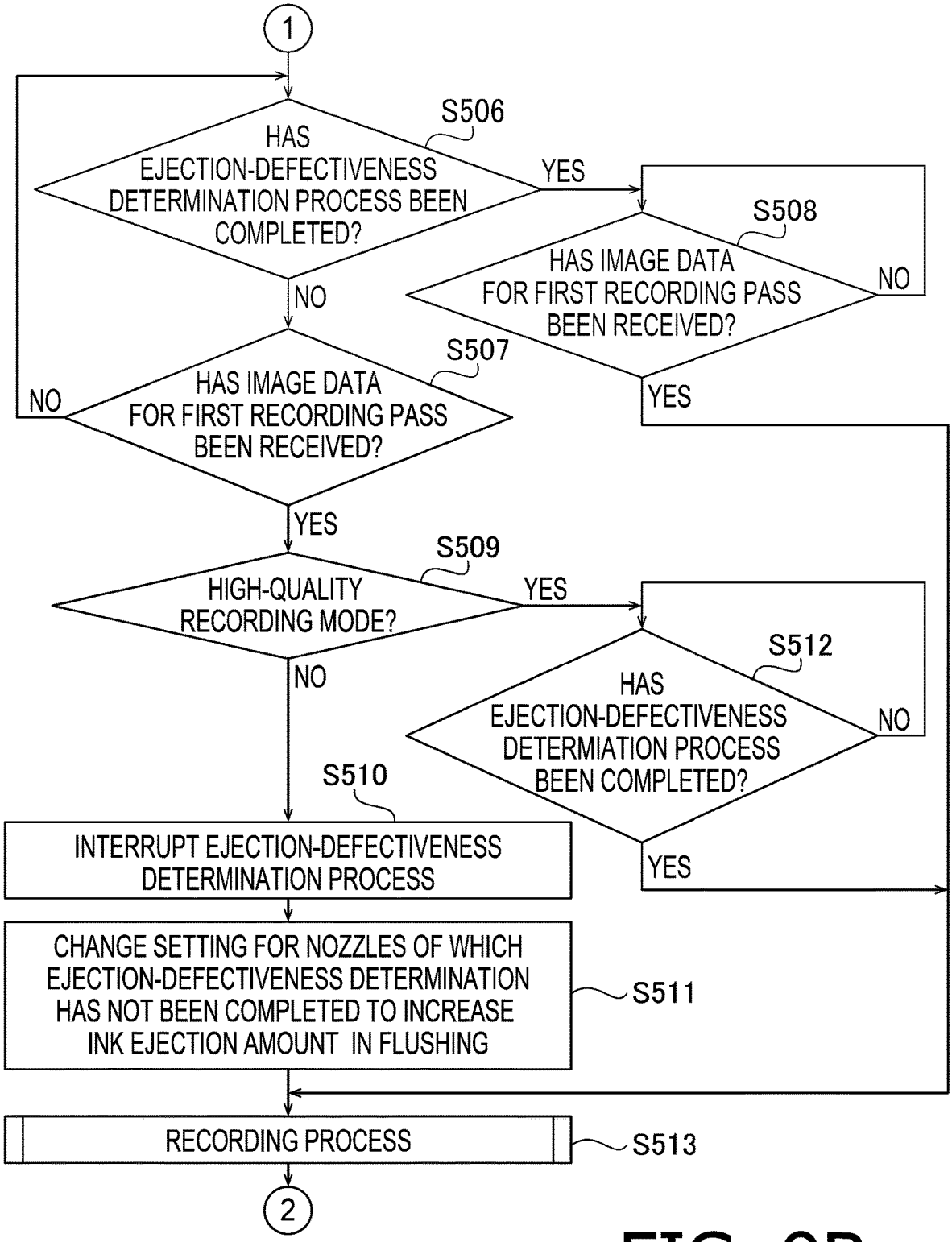

Further, in the first modification, the controller 80 performs a main process illustrated in a flowchart shown in FIGS. 9A and 9B when recordation on the recording sheet P is performed. As shown in FIG. 9A, the controller 80 pauses until the preparation signal is input (S501: NO). When the preparation signal is input (S501: YES), the controller 80 estimates a receiving time period Tj which is a time period from completion of receipt of the preparation signal till receipt of the image data for the first recording pass is completed (S502). The receiving time period Tj is estimated based on, for example, whether the recording mode is the normal-quality recording mode or the high-quality recording mode.

Next, when the estimated receiving time period Tj is longer than a time period T1 necessary for performing the ejection-defectiveness determination process (S503: YES), the controller 80 starts the first ejection-defectiveness determination process (S504). On the other hand, when the estimated receiving time period Tj is shorter than the time T1 (S503: NO), the controller 80 starts the second ejection-defectiveness determination process (S505). After the execution of S504 or S505, the controller 80 performs processes in S506-S513, which are the same as the processes in S103-S110, except that the second ejection-defectiveness determination process is performed in S511. In S511, the controller changes the setting so that the ink discharging amount in the flushing is increased for all the particular number of nozzles 10 which are determined to include the ejection-defective nozzle.

In the first modification, when the estimated receiving time period Tj is longer than the time period T1 necessary for performing the first ejection-defectiveness determination process, the controller 80 starts the first ejection-defectiveness determination process to determine whether the nozzles 10 are ejection-defective nozzles, respectively. Thus, for the plural nozzles 10 of the inkjet head 4, whether or not the respective nozzles 10 are the ejection-defective nozzles is determined.

On the other hand, when the receiving time period Tj is shorter than the time T1, the controller 80 performs the second ejection-defectiveness determination process. In this case, for the plural nozzles 10 of the inkjet head 4, whether or not each of the nozzles 10 is the ejection-defective nozzle cannot be determined, but the time period necessary for performing the ejection-defectiveness determination process can be shortened.

In the first modification, the controller 80 estimates the receiving time period Tj, and selectively performs the first ejection-defectiveness determination process or the second ejection-defectiveness determination process depending on whether or not the receiving time period Tj is equal to or longer than the time T1 necessary for performing the first ejection-defectiveness determination process or not. However, aspects of the present disclosures do not need to be limited to such a configuration. That is, the controller 80 may estimate another time period related to a time period necessary to perform the first ejection-defectiveness determination process (e.g., a time period necessary for receiving the preparation signal and the image data for the first recording pass). Then, depending on whether or not the estimated time period is equal to or longer than the time period necessary for performing the first ejection-defectiveness determination process, the controller 80 may selectively perform the first ejection-defectiveness determination process or the second ejection-defectiveness determination process.

According to the first modification described above, the controller 80 controls the inkjet head 4 to eject the ink droplet through one nozzle 10, and determines whether the one nozzle 10 is the ejection-defective nozzle or not based on the determination signal in the first ejection-defectiveness determination process. Further, the controller 80 drives the inkjet head 4 to cause multiple nozzles 10 to eject the ink droplets, and determines whether or not the multiple nozzles 10 include the ejection-defective nozzle based on the determination signal. Accordingly, the time period necessary for performing the second ejection-defectiveness process is shorter than the time period necessary for performing the first ejection-defectiveness process. However, aspects of the present disclosures do not need to be limited to such a configuration.

For example, in each of the first ejection-defectiveness determination process and the second ejection-defectiveness determination process, the controller 80 drives the inkjet head 4 to cause one nozzle 10 to eject the ink droplet, and determines whether the one nozzle 10 is the ejection-defective nozzle or not based on the determination signal in the first ejection-defectiveness determination process. Further, in the first ejection-defectiveness determination process, whether each of all the nozzles 10 of the inkjet head 4 is the ejection-defective nozzle or not is determined. In contrast, in the second ejection-defectiveness determination process, whether each of only the nozzles in which the ink thickens easily is the ejection-defective nozzle or not is determined. According to the above configuration, the time period necessary for performing the second ejection-defectiveness determination process can be shortened than the time period for performing the first ejection-defectiveness determination process.

It is noted that the nozzles 10 in which the ink thickens easily are, for example, the nozzles 10 ejecting the black ink, a particular number of nozzles 10 arranged on outer sides, in the conveying direction, of the nozzles 10 of each nozzle array 9, or the like.

In the above-described embodiment, when the image data for the first recording pass has been received before the ejection-defectiveness determination process is completed, whether (1) the ejection-defectiveness determination process is interrupted during execution and the recording process is performed, or (2) the recording process is performed after the ejection-defectiveness determination process is completed, is determined depending on whether recordation is performed in the normal-quality recording mode or the high-quality recording mode. However, aspects of the present disclosures do not need to be limited to such a configuration.

Figure 10:
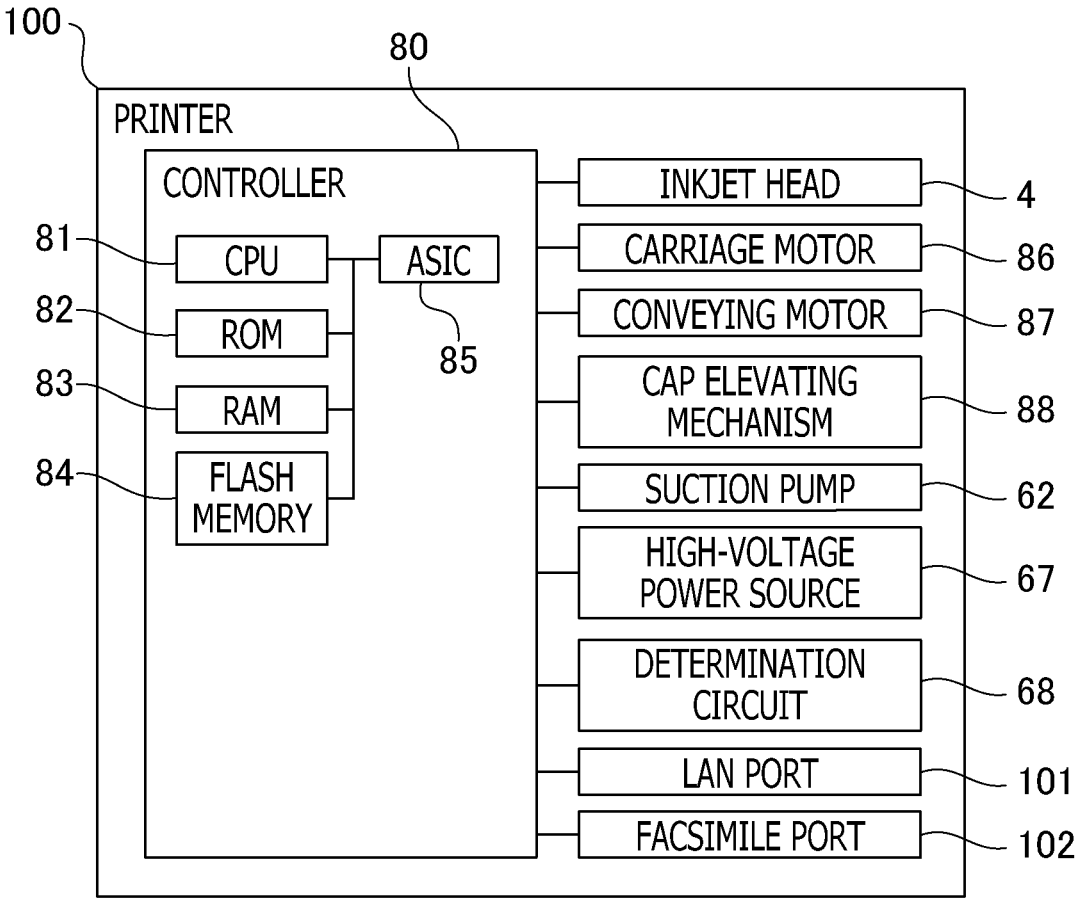
FIG. 10 is a block diagram illustrating an electric configuration of a printer according to a second modification of the present embodiment.

In a second modification, as shown in FIG. 10, a printer 100 is provided with a LAN port 101 to be connected to a LAN and a facsimile port 102 for a facsimile communication, as communication ports to communicate with an external device. It is noted that the facsimile port 102 is an example of a facsimile communication part. In the second modification, the LAN port 101 is an example of communication other than the facsimile communication part. Further, the LAN port 101 may be configured to be connected to the LAN with either the wired or wireless connection.

Figure 11:
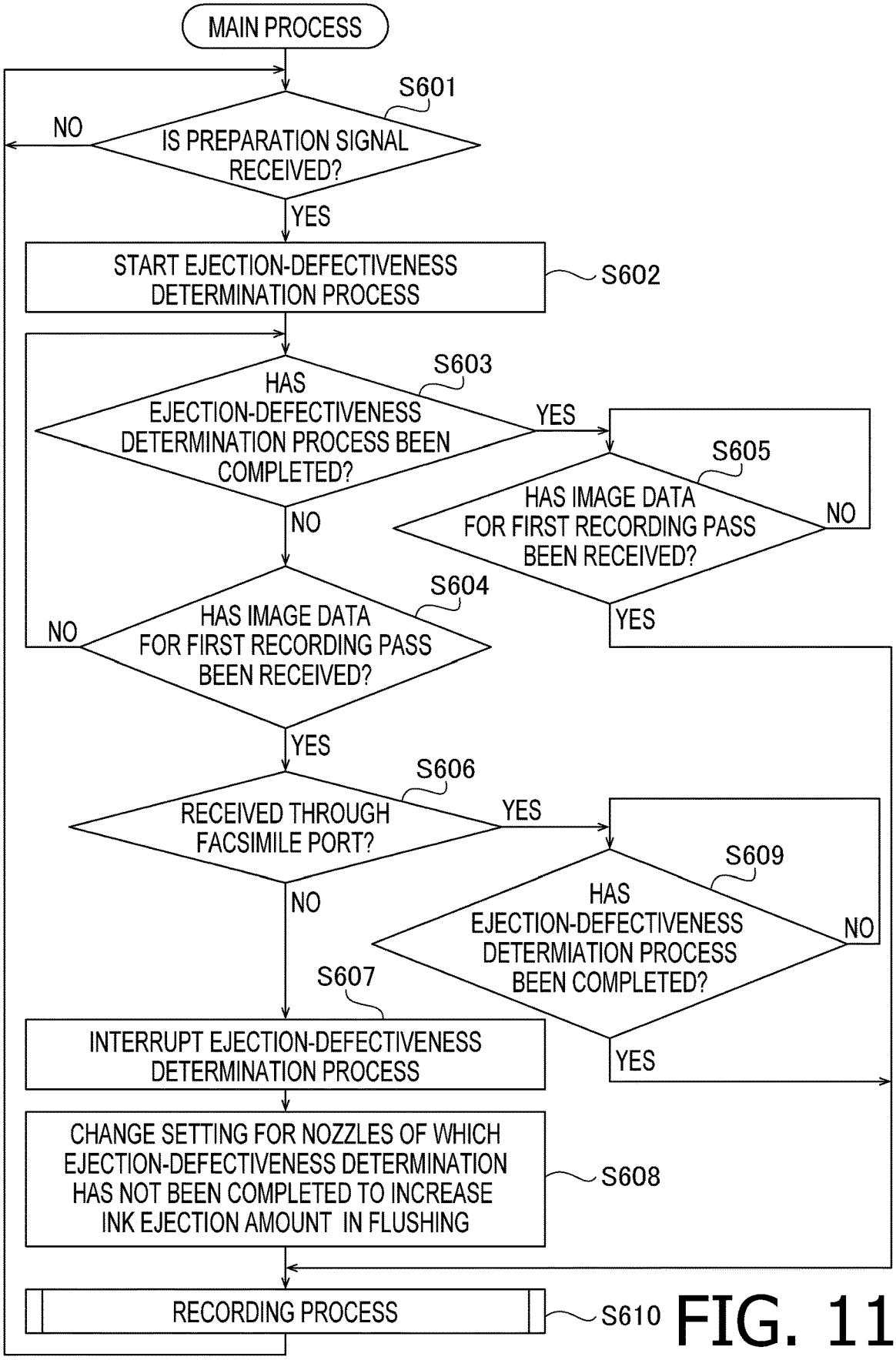
FIG. 11 is a flowchart illustrating a main process of the printer according to the second modification.

According to the second modification, when recoding to the recording sheet P is performed, the controller 80 performs a main process, which is illustrated in a flowchart shown in FIG. 11.

The controller 80 performs processes of S601-S605, which are the same as the processes in S101-S105 shown in FIG. 5. When the image data for the first recording pass has been received (S604: YES) before the ejection-defectiveness determination process is completed (S603: NO), the controller 80 determines whether the preparation signal and the image data have been received through the facsimile port 102 (S606).

When it is determined that the preparation signal and the image data have been received through the LAN port 101 (S606: NO), the controller 80 instructs to interrupt the ejection-defectiveness determination process (S607), changes a setting so that the ink discharging amount in the flushing is increased for the nozzles 10 for which the ejection-defectiveness determination process has not been completed (S608), and proceeds to the recording process in S610.

On the other hand, when the image data and the preparation signal have been received through the facsimile port 102 (S606: YES), the controller 80 pauses until the ejection-defectiveness determination process has been completed (S609: NO). When the ejection-defectiveness determination process has been completed (S609: YES), the controller 80 proceeds to S610. It is noted that the recording process in S610 is the same as S110 of FIG. 5.

Generally, in the printer, the received preparation signal and the image data are deleted after recording. However, recording other than that of received facsimile, it is possible to receive the preparation signal and the image data again by transmitting, from the PC, the smartphone, or the like, a request for re-transmission of the preparation signal and the image data, respectively. Thus, recording can be performed based on the image data received again. In such a case, when the image data for the first recording pass has been received after the preparation signal is received and before the ejection-defectiveness determination process is completed, the ejection-defectiveness determination process is interrupted during execution, and recording of the image on the recording sheet P is performed. Thus, it is possible to avoid the starting of recording on the recording sheet P from being delayed.

In contrast, it is not ordinarily possible to re-receive the preparation signal and the image data regarding the facsimile. Therefore, recording cannot be performed again. Accordingly, even when the image data for the first recording pass has been received after the preparation signal has been received and before the ejection-defectiveness determination process is completed, the recording on the recording sheet P is performed after the ejection-defectiveness determination is completed. Thus, it is ensured that the image is recorded.

According to the above-described embodiment, when the ejection-defectiveness determination process is interrupted during execution, the ink ejection amount of the nozzles 10 for which the ejection-defectiveness determination process has not been performed is increased in comparison with the ink discharging amount of the nozzles 10 for which the ejection-defectiveness determination process has been completed. However, aspects of the present disclosures do not need to be limited to such a configuration. Even when the ejection-defectiveness determination process is interrupted during execution, the ink discharging amount of the nozzles 10 for which the ejection-defectiveness determination process has not been performed and the ink discharging amount of the nozzles 10 for which the ejection-defectiveness determination process has been completed could be the same in the flushing performed during the recording process.

It is noted that what is performed during the recording on the recording sheet P is not necessarily be the flushing. For example, the printer 1 may be configured to perform a suction purge for each nozzle array 9 so that the suction purge can be performed during the recording on the printing sheet P. Then, in the suction purge of the nozzle array, which includes the nozzles 10 for which the ejection-defectiveness determination process has not been completed, the ink discharging amount may be increased in comparison with a nozzle array 9, which does not include the nozzles 10 for which the ejection-defectiveness determination process has not been completed. It is noted that, in the above case, the maintenance unit 8, which performs the suction purge, is an example of a discharging device.

It is noted that a pressure pump may be provided in a middle portion of the tube 13 connecting the sub-tank 3 and the ink cartridge 15. Alternatively, a pressure pump connected to the ink cartridge may be provided to the printer. Then, a so-called pressure purge may be performed. The pressure purge is an operation to drive the pressure pump, with the plurality of nozzles 10 being covered with the cap 61, the ink inside the inkjet head 4 is pressurized, thereby the ink inside the inkjet head 4 being discharged through the plurality of nozzles 10. In this case, a combination of the cap 61 and the pressure pump is an example of the discharging device.

When the purge is performed, both the suctioning by the suction pump 62 and the pressurizing by the pressure pump may be performed. In this case, a combination of the maintenance unit 8 and the pressure pump is an example of the discharging device.

In the above-described examples, when the image data for the first recording pass has been received before completion of the ejection-defectiveness determination process, whether the ejection-defectiveness determination process is to be interrupted or not is determined depending on a particular condition is satisfied or not. Aspects of the present disclosures do not need to be limited to the above configuration. That is, when the image data for the first recording pass has been received before completion of the ejection-defectiveness determination process, the ejection-defectiveness determination process may always be interrupted. Alternatively, it is configured that the recording process is always performed after the ejection-defectiveness determination process is completed, including a case where the image data for the first recording pass has been received before completion of the ejection-defectiveness determination process.

Further, according to the above-described embodiment, in the ejection-defectiveness determination process immediately before the recording, the nozzles 10 ejecting the black ink and the nozzles 10 ejecting the color inks are examined in this order, and further, for the multiple nozzles 10 of each nozzle array 9, whether the nozzle 10 is the ejection-defective nozzle is determined from the outer side one, in the conveying direction, to the central one in this order. On the other hand, in the ejection-defectiveness determination process performed at a timing which is not immediately before the recording, the nozzles 10 ejecting the color inks and the nozzles 10 ejecting the black ink are examined in this order, and further, for the multiple nozzles 10 of each nozzle array 9, whether the nozzle 10 is the ejection-defective nozzle is determined from the central one, in the conveying direction, to the outer side one in this order. Aspects of the present disclosures do not need to be limited to such a configuration.

In the ejection-defectiveness determination process, which is performed immediately before the recording, the nozzles 10 ejecting the black ink and the nozzles 10 ejecting the color inks may be examined in this order. Further, for the multiple nozzles 10 of each nozzle array 9, each nozzle may be examined in the order different from the above-explained order to find the ejection-defective nozzles.

In the ejection-defectiveness determination process, which is performed at a timing not immediately before the recording, the nozzles 10 ejecting the color inks and the nozzles 10 ejecting the black ink may be examined in this order. Further, for the multiple nozzles 10 of each nozzle array 9, each nozzle may be examined in the order different from the above-explained order to find the ejection-defective nozzles.

In the ejection-defectiveness determination process, which is performed immediately before the recording, the four nozzle arrays 9 may be examined differently from the above-described order. Further, the multiple nozzles of each array may be examiner from the outside ones toward the central side ones, in the conveying direction.

In the ejection-defectiveness determination process, which is performed at a timing not immediately before the recording, the four nozzle arrays 9 may be examined in the order different from the above-described order. Further, the multiple nozzles of each array may be examiner from the central ones toward the outside ones, in the conveying direction.

In the ejection-defectiveness determination processes which is performed immediately before the recording and performed at a timing not immediately before the recording, the multiple nozzles 10 may be examined in the orders, which are different from the above-described orders and which are different from each other. Optionally, the order of examining the multiple nozzles 10 may be determined, for example, based on ink ejecting conditions of the multiple nozzles 10 when the previous recording was performed.

In the ejection-defectiveness determination processes, which is performed immediately before the recording and performed at a timing not immediately before the recording, the multiple nozzles 10 are examined in different orders according to the present embodiment. Aspects of the present disclosures do not need to be limited to such a configuration. For example, regardless of whether the ejection-defectiveness determination processes are performed immediately before the recording or at a timing not immediately before the recording, the multiple nozzles 10 may be examined in a fixed order.

In the above-described embodiment, it is determined whether the image data for the first recording pass has been received in S104 or S105. The process may be modified such that, in S104 and S105, it may be determined whether the image data for a particular number (more than one) of successive recording passes including the first one has been received. In such a modification, the image data for the particular number (two or more) of recording passes is an example of the ejection data. Alternatively, in S104 and S105, it may be determined whether the image data for all the recording passes has been received. In such a modification, the image data for all the recording passes is an example of the ejection data.

In the above-described embodiment, all the nozzles 10 of the inkjet head 4 are examined in the abnormal determination process. Aspects of the present disclosures do not need to be limited to the configuration. That is, only a part of the plurality of nozzles 10 may be examined.

In the above-described embodiment, the ink droplet is ejected, from the nozzle 10, to the detection electrode 66, and the determination circuit 68 is configured to output the determination signal depending on the voltage value of the detection electrode 66 when the ink droplet is ejected. Aspects of the present disclosures do not need to be limited to the configuration.

For example, a detection electrode extending in the up-down direction may be arranged, and the determination circuit may be configured to output a determination signal depending on a voltage value of the detection electrode when the nozzle 10 is caused to eject the ink droplet so as to pass through an area facing the election electrode. For another example, an optical sensor to detect the ink droplet ejected from the nozzle 10 may be provided, and the optical sensor may be configured to output the determination signal based on the detection result. In this case, the optical sensor is an example of the determination signal output part.

Alternatively, a voltage detecting circuit (which is an example of a determination signal output part) configured to detect a variation of voltage when the ink droplet is ejected from the nozzle may be connected to the plate on which the nozzles may be formed, and the voltage detecting circuit may be configured to output the determination signal to the controller 80. Such a configuration is disclosed in the United States Patent Provisional Publication No. 2007-0139461 A1 (filed on Dec. 7, 2006), the disclosures of which are incorporated herein by reference.

Alternatively, a substrate of the inkjet head may be configured to include a temperature detection element (which is an example of a determination signal output part). After the heater is driven by applying a first application voltage to the inkjet head so that the ink droplet is ejected, and thereafter, the heather is driven to apply a second application voltage to the inkjet head so that the ink droplet is not ejected. The temperature detection element may detect a variation of the detected temperature from the application of the second voltage to an elapse of a particular time period, and output the determination signal based on the change of the temperature detected by the temperature detection element.

In the above example, each nozzle 10 is examined to determine whether an ink droplet is ejected from the nozzle, and the nozzle from which the ink droplet is not ejected is determined to be the ejection-defective nozzle. Aspects of the present disclosures do not need to be limited to such a configuration. For example, a configuration to detect an ink ejection speed or an ink ejection direction of the ink droplet ejected from the nozzle may be provided, and the nozzle of which the ink ejection speed or the ink ejection direction is abnormal may be determined to be the ejection-defective nozzle.

An example employing the printer provided with a so-called serial head, which is configured to move in the scanning direction with the carriage, is described in the description above. Aspects of the present disclosures do not need to be limited to such a configuration. That is, another example may employ a printer provided with a so-called line head, which extends over an entire length, in the scanning direction, of the recording sheet P.

In the above description, aspects of the present disclosures are applied to the printer, which is configured to record on the recording sheet P by causing the nozzles to eject the ink droplets. However, aspects of the present disclosures do not need to be limited to such a configuration, but can be applied to a printer configured to record an image on a recording medium other than the recording sheet P. Examples of such recording media include, for example, a T-shirt, a sheet for outdoor advertisement, a case for a portable terminal (e.g., a smartphone), cardboard, a resin member and the like. Further, aspects of the present disclosure may also be applied to a liquid ejection device configured to eject a liquid other than the ink (e.g., liquefied resin, liquefied metal or the like).

What is claimed is:

1. A liquid ejection device, comprising:

a liquid ejection head having multiple nozzles;

a determination signal output part configured to output a determination signal corresponding to whether each of the multiple nozzles is an ejection-defective nozzle of which ejection performance is lower than a predefined ejection performance; and a controller, wherein the controller is configured to perform receiving a preparation signal, the preparation signal being a signal instructing preparation to eject the liquid based on an ejection data, the preparation signal being externally issued upon issuance of an ejection instruction to eject the liquid toward a target medium based on the ejection data, and starting to receive the ejection data after the preparation signal is received, the ejection data being externally transmitted on a condition that the ejection instruction is issued and after the preparation signal is issued, wherein, after having received the preparation signal and before completion of receiving the ejection data, the controller is configured to perform controlling the liquid ejection head such that the multiple nozzles eject the liquid to determine whether each of the multiple nozzles is an ejection-defective nozzle, performing an ejection-defectiveness determination by examining at least a part of the multiple nozzles for ejection-defectiveness based on the determination signal, and controlling the liquid ejection head to eject the liquid toward the target medium through the multiple nozzles based on the ejection data.

2. The liquid ejection device according to claim 1, wherein the controller is configured to perform:

after receiving the preparation signal, the ejection-defectiveness determination at a different timing which is different from a timing before completion of receipt of the ejection data; and after receiving the preparation signal, the ejection-defectiveness determination by determining whether nozzles included in at least a part of the multiple nozzles are ejection-defective nozzles by driving the liquid ejection head to eject the liquid through the multiple nozzles in a different order which is different from the order when performing the ejection-defectiveness determination before reception of the ejection data is completed.

3. The liquid ejection device according to claim 2, wherein the multiple nozzles include first nozzles and second nozzles, the liquid being thickened easily in the second nozzles than in the first nozzles, wherein the controller is configured to perform:

in the ejection-defectiveness determination performed after receiving the preparation signal and before completion of receiving the ejection data, determining whether the first nozzle is the ejection-defective nozzle by driving the liquid ejection head to eject the liquid through the first nozzle after determining whether the second nozzle is the ejection-defective nozzle by driving the liquid ejection head to eject the liquid through the second nozzle; and in the ejection-defectiveness determination performed at the different timing, determining whether the second nozzle is the ejection-defective nozzle by driving the liquid ejection head to eject the liquid through the second nozzle after determining whether the first nozzle is the ejection-defective nozzle by driving the liquid ejection head to eject the liquid through the first nozzle.

4. The liquid ejection device according to claim 1, wherein the controller is configured such that, when receipt of the ejection data is completed after the preparation signal is received and before completion of the ejection-defectiveness determination, the controller performs:

interrupting the ejection-defectiveness determination during execution of the ejection-defectiveness determination; and controlling the liquid ejection head to eject the liquid toward the target medium.

5. The liquid ejection device according to claim 4, further comprising a discharging device configured to cause the ejection head to perform discharging the liquid through the multiple nozzles, wherein the controller is configured to perform controlling the discharging device to discharge the liquid during the liquid ejection head being controlled to eject the liquid, and wherein, when the controller controls the discharging device to discharge the liquid through the multiple nozzles by interrupting the ejection-defectiveness determination during execution of the ejection-defectiveness determination, the controller controls a discharging amount of the liquid to be more for the nozzles for which the ejection-defectiveness determination have not been completed than for the nozzles for which the ejection-defectiveness determination have been completed.

6. The liquid ejection device according to claim 4, wherein the controller is configured to control the liquid ejection head to eject the liquid toward the target medium through the multiple nozzles to record an image on the target medium in one of a first recording mode and a second recording mode, the image being recording in a higher quality in the second recording mode than in the first recording mode, and wherein, when the ejection data has been received after the preparation signal is received and before completion of the ejection-defectiveness determination, the controller performs when the image is to be recorded in the first recording mode, interrupting the ejection-defectiveness determination during execution of the ejection-defectiveness determination and controls the liquid ejection head to eject the liquid toward the target medium through the multiple nozzles, and when the image is to be recording in the second recording mode, driving the liquid ejection head to eject the liquid toward the target medium through the multiple nozzles after completion of the ejection-defectiveness determination.

7. The liquid ejection device according to claim 4, further comprising:

a facsimile communication device configured to perform a facsimile communication; and a reception port configured to receive a signal and data for communication other than the facsimile communication, wherein both the facsimile communication device and the reception port are configured to receive the preparation signal and the ejection data, wherein the controller is configured to:

control the liquid ejection head to eject the liquid toward the target medium to record an image on the target medium;

when the preparation signal and the ejection data are received through the facsimile communication device, control the liquid ejection head to eject the liquid toward the target medium after completion of the ejection-defectiveness determination when receipt of the ejection data is completed after receipt of the preparation signal and before completion of the ejection-defectiveness determination, and when the preparation signal and the ejection data are received through the reception port, interrupt the ejection-defectiveness determination during execution of the ejection-defectiveness determination and control the liquid ejection head to eject the liquid toward the target medium when receipt of the ejection data is completed after receipt of the preparation signal and before completion of the ejection-defectiveness determination.

8. The liquid ejecting device according to claim 1, wherein the controller is further configured to:

selectively perform one of a first ejection-defectiveness determination and a second ejection-defectiveness determination as the ejection-defectiveness determination, a determination period from a start to a completion of determination being shorter in the first ejection-defectiveness determination than in the second ejection-defectiveness determination;

when the preparation signal is received:

estimate an estimated period from receipt of the preparation signal to completion of receipt of the ejection data;

when the estimated period is equal to or longer than the determination period for the first ejection-defectiveness determination, perform the first ejection-defectiveness determination after the preparation signal is received and before completion of the receipt of the ejection data; and when the estimated period is shorter than the determination period for the first ejection-defectiveness determination, perform the second ejection-defectiveness determination after the preparation signal is received and before completion of the receipt of the ejection data.

9. The liquid ejection device according to claim 8, wherein the controller is further configured to:

when the first ejection-defectiveness determination is performed, control the liquid ejection head to eject the liquid through one of the nozzles and determine whether the one of the nozzles is the ejection-defective nozzle based on the determination signal output by the determination signal output part; and when the second ejection-defectiveness determination is performed, control the liquid ejection head to eject the liquid through multiple nozzles of the nozzles and determine whether the multiple nozzles of the nozzles include the ejection-defective nozzle based on the determination signal output by the determination signal output part.

10. The liquid ejection device according to claim 1, wherein the liquid ejection device is an inkjet printer, and wherein the liquid comprises ink for the inkjet printer.

11. The liquid ejection device according to claim 1, wherein even if image data for a first recording pass is received before the ejection-effectiveness determination is completed, the controller is configured to complete or interrupt the ejection-effectiveness determination depending on whether a particular condition for determining whether the recording process needs to be performed after the ejection-effectiveness determination is completed is met.

12. A method of controlling a liquid ejection device having a liquid ejection head having multiple nozzles, and a determination signal output part configured to output a determination signal corresponding to whether each of the multiple nozzles is an ejection-defective nozzle of which ejection performance is lower than a predefined ejection performance, the method comprising:

receiving a preparation signal, the preparation signal being a signal instructing preparation to eject the liquid based on ejection data, the preparation signal being externally issued upon issuance of an ejection instruction to eject the liquid toward a target medium based on the ejection data; and starting to receive the ejection data after the preparation signal is received, the ejection data being externally transmitted on a condition that the ejection instruction is issued and after the preparation signal is issue, wherein, after having received the preparation signal and before completion of receiving the ejection data, the controller is configured to perform controlling the liquid ejection head such that the multiple nozzles eject the liquid to determine whether each of the multiple nozzles is an ejection-defective nozzle, performing an ejection-defectiveness determination by examining at least a part of the multiple nozzles for ejection-defectiveness based on the determination signal, and controlling the liquid ejection head to eject the liquid toward the target medium through the multiple nozzles based on the ejection data.

13. A non-transitory computer-readable recording medium for a liquid ejection device having a liquid ejection head having multiple nozzles, a determination signal output part configured to output a determination signal corresponding to whether each of the multiple nozzles is an ejection-defective nozzle of which ejection performance is lower than a predefined ejection performance and a controller, wherein the controller is configured to execute instruction contained in the recording medium to control the liquid ejection device to perform receiving a preparation signal, the preparation signal being a signal instructing preparation to eject the liquid based on ejection data, the preparation signal being externally issued upon issuance of an ejection instruction to eject the liquid toward a target medium based on the ejection data, starting to receive the ejection data after the preparation signal is received, the ejection data being externally transmitted on a condition that the ejection instruction is issued and after the preparation signal is issued, and wherein, after receiving the preparation signal and before completion of receiving the ejection data, the controller is configured to further control the liquid ejection device to perform controlling the liquid ejection head such that the multiple nozzles eject the liquid to determine whether each of the nozzles is an ejection-defectiveness nozzle, performing an ejection-defectiveness determination by examining at least a part of the multiple nozzles for ejection-defectiveness based on the determination signal, and controlling the liquid ejection head to eject the liquid toward the target medium through the multiple nozzles based on the ejection data.

* * * * *